US006065519A

United States Patent [19]

Lee

[11] Patent Number: 6,065,519

[45] Date of Patent: May 23, 2000

[54] AUTOMATIC DRAWING AND CUTTING DEVICE FOR ADHESIVE TAPE DISPENSER

[76] Inventor: Sang-Chul Lee, 707-1403, Jugong Apt., Haan-dong 295, Kwangmyong-shi, Rep. of Korea, 423-060

[21] Appl. No.: 09/222,131

[22] Filed: Dec. 29, 1998

Related U.S. Application Data

[63] Continuation-in-part of application No. 08/993,411, Dec. 18, 1997, abandoned.

[30] Foreign Application Priority Data

Dec. 30, 1996 [KR] Rep. of Korea ..... 96-77415

[51] Int. Cl.[7] ..... B32B 31/00

[52] U.S. Cl. ..... 156/523; 156/579; 156/510; 83/649; 225/10; 225/16

[58] Field of Search ..... 225/10, 11, 14, 225/15; 83/649; 156/527, 577, 579, 574, 523, 510

[56] References Cited

U.S. PATENT DOCUMENTS

| | | | |
|---|---|---|---|
| 2,822,046 | 2/1958 | Krueger | 225/11 X |
| 3,035,345 | 5/1962 | Barnard | 225/14 X |
| 3,050,853 | 8/1962 | Domeny | 83/649 X |
| 3,194,463 | 7/1965 | Comet | 225/16 |
| 3,386,634 | 6/1968 | Curry | 83/649 X |
| 4,262,835 | 4/1981 | Wrobel | 225/15 X |
| 4,630,765 | 12/1986 | Samuelson et al. | 83/649 X |
| 5,595,626 | 1/1997 | Yokouchi et al. | 156/579 X |
| 5,759,342 | 6/1998 | Luhman et al. | 156/579 X |
| 5,851,348 | 12/1998 | Muenzer et al. | 156/574 X |
| 5,910,227 | 6/1999 | Mistyurik et al. | 156/579 X |

*Primary Examiner*—Rinaldi I. Rada
*Assistant Examiner*—Ana Luna
*Attorney, Agent, or Firm*—Reed Smith Hazel & Thomas LLP

[57] ABSTRACT

The present invention relates to an automatic drawing and cutting device for an adhesive tape dispenser. The adhesive tape dispenser includes a case body for containing an adhesive tape and having a detachable cover, a drawing means for automatically drawing the adhesive tape from the case body in a desired length, and a cutting means for automatically cutting the adhesive tape drawn by the drawing means. According to this automatic drawing and cutting device for an adhesive tape dispenser, the adhesive tape may be automatically drawn from the adhesive tape dispenser in a desired length by pulling a handle of the drawing means with a user's finger cutting the drawn adhesive tape by only sliding forward a sliding member of the cutting means, thus improving the convenience of operation.

4 Claims, 4 Drawing Sheets

AUTOMATIC DRAWING AND CUTTING DEVICE FOR ADHESIVE TAPE DISPENSER

This application is a continuation-in-part of application Ser. No. 08/993,411, filed Dec. 18, 1997, now abandoned.

BACKGROUND OF THE INVENTION

1. Field of the Invention

The present invention relates to an adhesive tape case, and more particularly to, an automatic drawing and cutting device for an adhesive tape dispenser, in which an adhesive tape may be automatically drawn from an adhesive tape dispenser and cut automatically so that users may use the adhesive tape conveniently.

2. Description of the Prior Art

In general, adhesive tape dispensers have an opening at one side thereof through which an adhesive tape is detachably mounted. Most of the conventional adhesive tape dispensers have a saw toothed cutting blade which is integrally formed or detachably located at a front end part thereof so that a free end part of the adhesive tape is drawn from the tape dispenser and cut by the saw toothed cutting blade. After cutting, the free end part of the adhesive tape is attached on a shoulder part formed under the saw toothed cutting blade for next use.

Therefore, if users want to use the adhesive tape in the conventional adhesive tape dispenser, they have to detach the adhesive tape attached on the shoulder part of the tape dispenser with a finger, pull it as long as necessary, put it on the saw toothed cutting blade and strain downward so that the adhesive tape can be cut. However, all of this procedure is done manually and inconveniently, and the adhesive strength of the adhesive tape is weakened by fingerprints or dirt, since the users grasp the adhesive tape with a finger while using it.

SUMMARY OF THE INVENTION

An object of the present invention is to provide an automatic drawing and cutting device for an adhesive tape dispenser in which drawing means and cutting means are provided so that the adhesive tape may be automatically drawn from the adhesive tape dispenser and cut by simply pulling a handle of the drawing means and a sliding member of the cutting means, thus improving the convenience of operation.

The automatic drawing and cutting device for an adhesive tape dispenser according to the present invention includes a case body having a detachable cover, drawing means for automatically drawing an adhesive tape from the case body, and cutting means for automatically cutting the adhesive tape drawn from the case body by the drawing means. In virtue of the present invention, the adhesive tape may be automatically drawn from the adhesive tape dispenser into a desired length and then cut clean with good adhesive strength.

BRIEF DESCRIPTION OF THE DRAWINGS

These as well as other objects and advantages of this invention will be more completely understood and appreciated by the following detailed description of a presently preferred exemplary embodiment of the invention, taken in conjunction with the accompanying drawings, in which.

DETAILED DESCRIPTION OF THE PREFERRED EMBODIMENT

Figure 1:
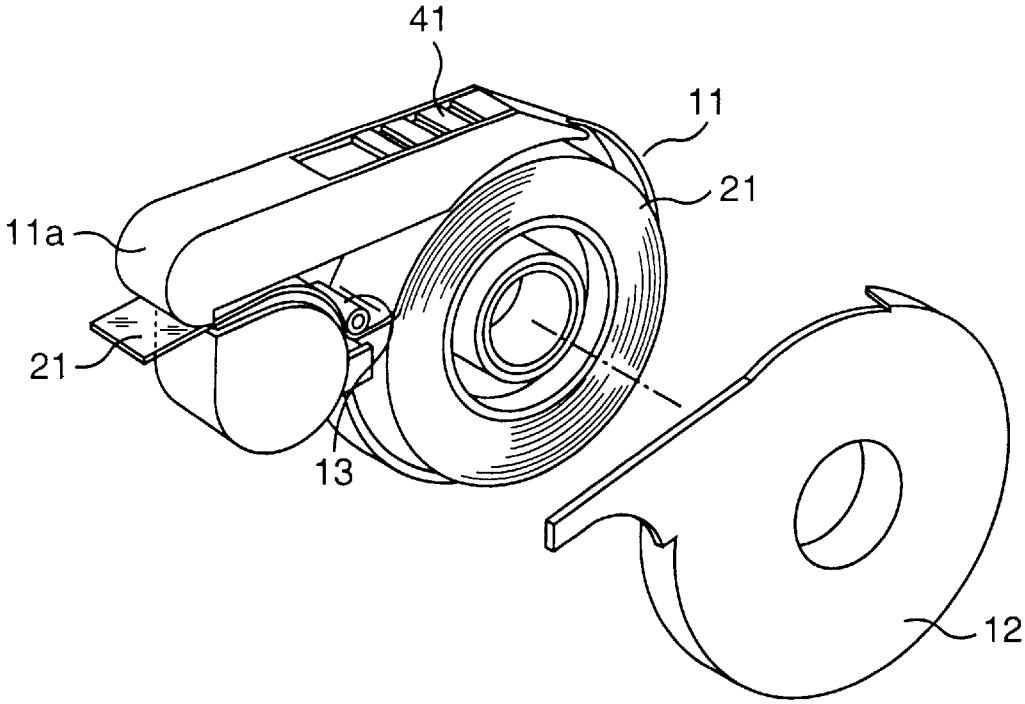
FIG. 1 is a perspective view showing an automatic drawing and cutting device for an adhesive tape dispenser according to the present invention.
Figure 2:
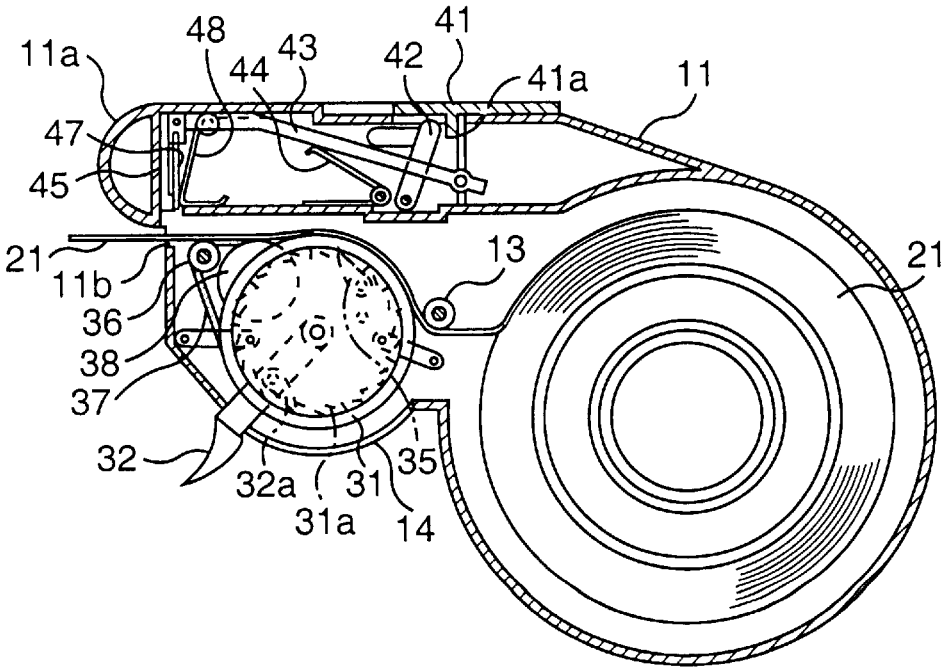
FIG. 2 is a cross-sectional view showing the construction of the automatic drawing and cutting device for an adhesive tape dispenser according to the present invention, as shown in FIG. 1.

FIG. 1 is a perspective view showing an automatic drawing and cutting device for an adhesive tape dispenser according to the present invention and FIG. 2 is a cross-sectional view showing the construction of the automatic drawing and cutting device for an adhesive tape dispenser of FIG. 1.

Referring to FIG. 1 and FIG. 2, the automatic drawing and cutting device for an adhesive tape dispenser according to the present invention includes a case body 11 having an outlet 11*b* through which an adhesive tape 21 is passed and a detachable cover 12, drawing means mounted at left side of the case body 11 to draw a free end part of the adhesive tape from the case body 11, and cutting means mounted on an upper part of the case body 11 for cutting the adhesive tape drawn from the case body 11 by the drawing means.

The drawing means includes a pair of latch drums 31 having a latch gear 31*a* on their inner peripherals respectively, a latch handle 32 rotatably mounted on a shaft 31*b* of the latch drums 31 and resiliently supported by a first coil spring 33 located on the shaft 31*b* of the latch drums 31, a push latch 32*a* pivotally mounted on the latch handle 32 by a pin protruded from the latch handle 32, the push latch 32*a* being resiliently supported by the first coil spring 33 to keep an engagement with one of the teeth of the latch gear 31*a,* a pair of rollers 36 connected with the latch drums 31 by a pair of belts 37 to allow the free end part of the adhesive tape 21 to be smoothly drawn, and a holding latch 34 resiliently supported by a second coil spring 35 and engaged with one of the teeth of the latch gear 31*a* in opposite direction of the push latch 32*a* to prevent the latch drums 31 from contrary rotation.

The latch handle 32, the push latch 32*a,* the coil springs 33 and 35, and the holding latch 34 are positioned between the latch drums 31.

Between the latch drums 31, a first bracket 39 and a second bracket 40 are also located at left and right sides respectively.

The first bracket 39 has a pin 39*a* in which an idle roller 38 is put. The idle roller 38 serves to smoothly draw the free end of the adhesive tape 21 with the pair of the rollers 36.

An end part of the first coil spring 33 located on the shaft 31*b* presses at one side of the push latch 32*a* and the other end part hooks up a pin 40*c* of the second bracket 40. An end part of the second coil spring 35 put on a pin 40*b* of the second bracket 40 presses at one side of the holding latch 34 and the other end part presses a corner of the second bracket 40. The holding latch 34 is pivotally mounted on a pin 40*a* of the second bracket 40. Therefore, by pressure of the coil springs 33 and 35, the push latch 32*a* and the holding latch 34 are respectively engaged with the teeth of the latch drums 31 so that they can prevent the contrary rotation of the latch drums 31 after the latch drums 31 were rotated in counterclockwise direction by pulling the latch handle 32.

The first and second brackets 39 and 40 are mounted in the case body 11 by pin joint.

Figure 6:
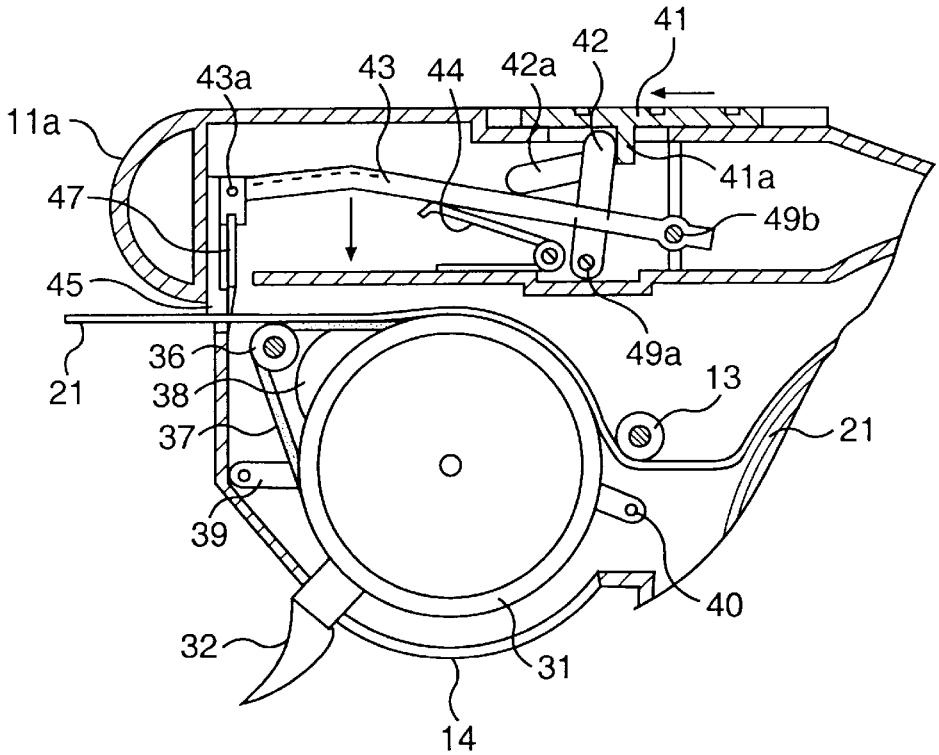
FIG. 6*a* is a cross-sectional view for explaining the operation principle of the cutting means according to the present invention.
FIG. 6*b* is a cross-sectional view for explaining the cutting operation of the cutting means according to the present invention.
Figure 6:
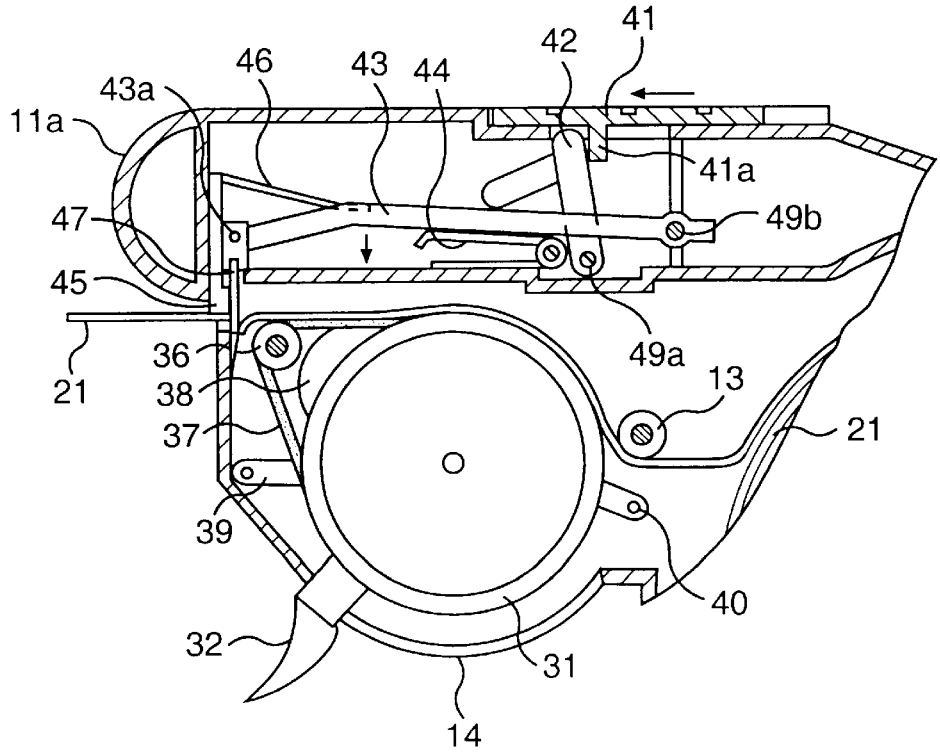

The cutting means includes a sliding member 41 slidingly positioned on the upper part of the case body 11 and having a protrusion 41*a;* a movable bar 42 being movable by forward sliding(as the arrow direction of FIGS. 6(*a*) and 6(*b*)) of the sliding member 41 and having a projection part 42*a,* a lever 43 having a cutter 47 at a front end of the lever 43, and being pressed down by pressure of the projection part 42*a* of the movable bar 42 moving forward by forward sliding of the sliding member 41, and a holder 45 positioned at the front end of the lever 43 having the cutter 47 and connected to the lever 43 by a pin-shaped spring 46 to support the cutter 47 and to hold the free end part of the adhesive tape 21 not to be moved during cutting of the drawn adhesive tape 21.

The unexplained reference numbers 49*a* represents a first hinge for mounting pivotally the movable bar 42, and 49*b* represents a second hinge for mounting pivotally the lever 43 in the case body 11.

Under the lever 43, a supporting spring 44 is mounted by another hinge of the case body 11 to give an elasticity to the lever 43.

The case body 11 has a protruded semicircular part 11*a* formed integrally at an upper front end part thereof to press down the free end part of the drawn adhesive tape 21 so that the adhesive tape 21 can be attached to an object.

As described above, according to the present invention, the automatic drawing and cutting device for adhesive tape dispenser can automatically draw the adhesive tape 21 through the outlet 11*b* from the case body 11 by simply pulling the latch handle 32 and then cut the drawn adhesive tape 21 with the cutter 47 by sliding forward the sliding member 41.

Figure 3:
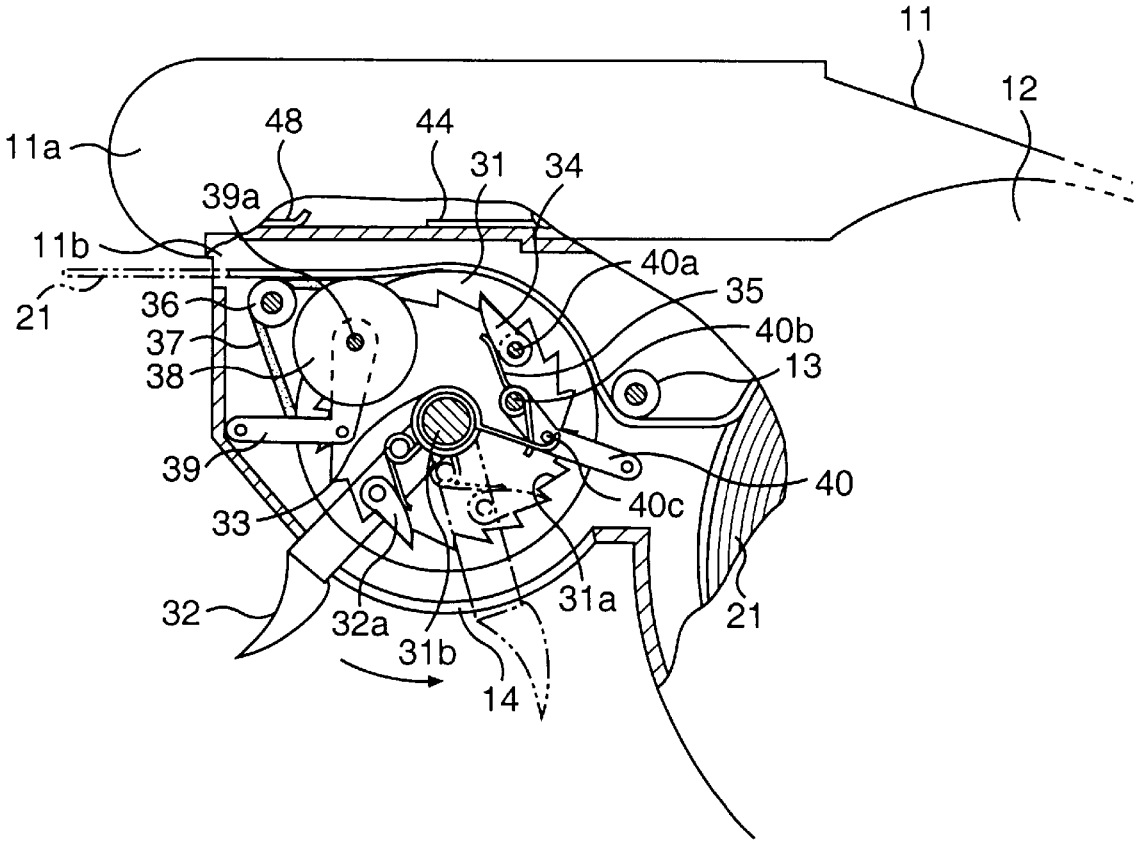
FIG. 3 is a partially taken cross-sectional view of drawing means according to the present invention.
Figure 4:
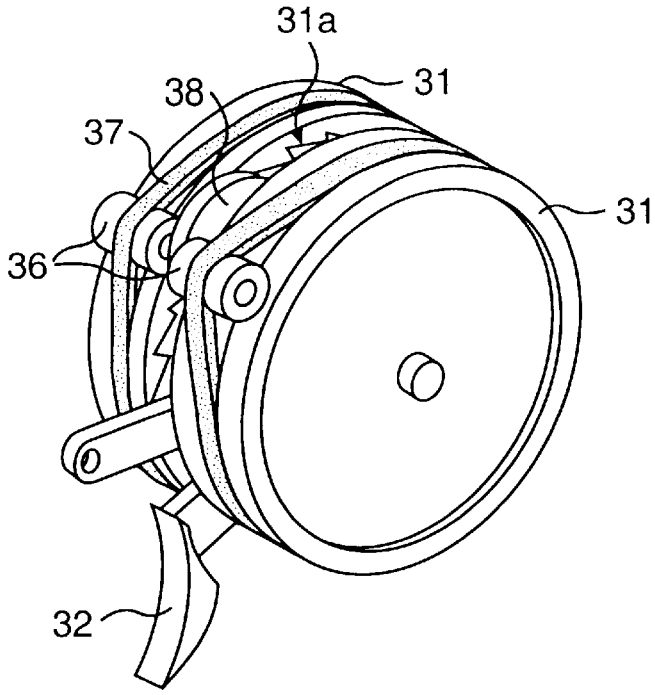
FIG. 4 is a perspective view of the drawing means of FIG. 3.
Figure 5:
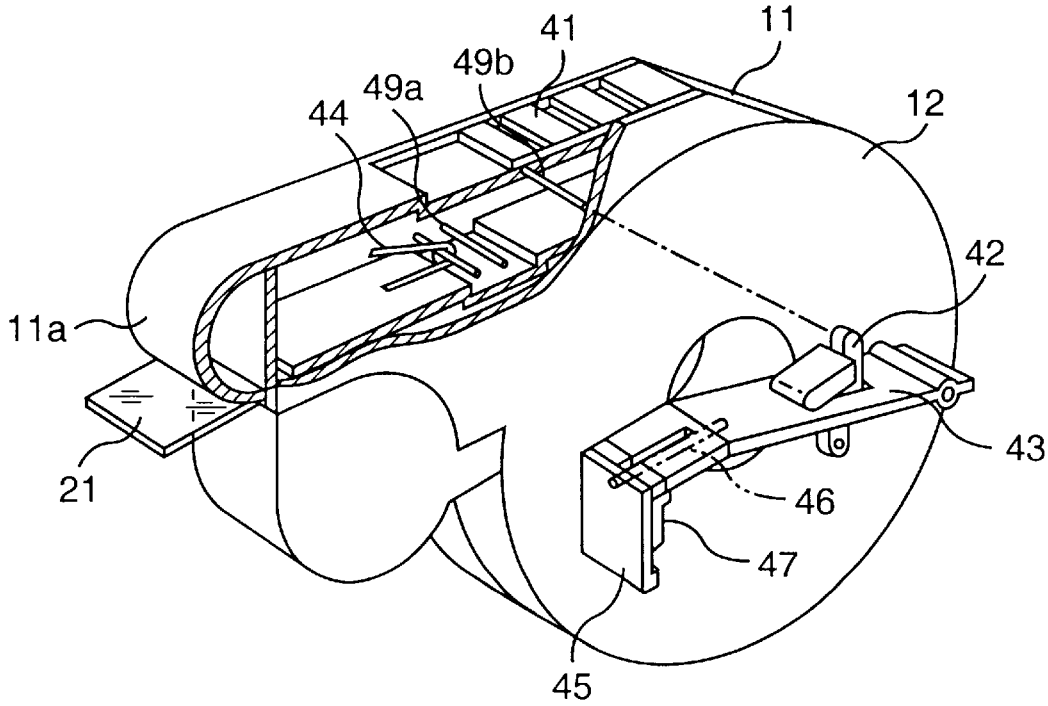
FIG. 5 is a detailed perspective view of cutting means, separately taken from the automatic drawing and cutting device for adhesive tape dispenser according to the present invention.

FIG. 3 is a partially taken cross-sectional view of the drawing means of the automatic drawing and cutting device for an adhesive tape dispenser according to the present invention. FIG. 4 is a perspective view showing the construction of the drawing means of FIG. 3. FIG. 5 is a perspective view of the cutting means, separately taken from the automatic drawing and cutting device for an adhesive tape dispenser according to the present invention. FIG. 6*a* is a cross-sectional view explaining the operation principle of the cutting means of the automatic drawing and cutting device for an adhesive tape dispenser according to the present invention, and FIG. 6*b* is a cross-sectional view explaining the cutting operation of the cutting means of the automatic drawing and cutting device for an adhesive tape dispenser according to the present invention.

The method of use of the automatic drawing and cutting device for an adhesive tape dispenser according to the present invention is as follows.

If the user grasps the case body 11 in hand and pulls the latch handle 32 into counterclockwise direction with a finger, for example, a first finger, the first coil spring 33 is compressed, and the push latch 32*a* which is engaged with one of the teeth of the latch gear 31*a* of the latch drums 31 is moved with the latch handle 32 in the counterclockwise direction of FIG. 3, so that the latch drums 31 is rotated in the counterclockwise direction.

The latch drums 31 have an angle of rotation corresponding to the pulled extent of the latch handle 32. The latch handle 32 can be pulled within the extent of a groove 14 formed in the case body 11.

By the above manner, the adhesive tape 21 is drawn outwardly through the outlet 11*b* to the extent of the length rotated of the latch drums 31 under the guidance of the belts 37 surrounding the latch drums 31 and the rollers 36 and 38. When the user releases the pulled latch handle 32, the latch handle 32 returns to its original position by the elasticity of the coil spring 33 and the push latch 32*a* engaged with one of the teeth of the latch gear 31*a* is released from the engagement with the tooth of the latch gear 31*a* and moved in the clockwise direction to the extent of the length returned of the latch handle 32 to engage another tooth of the latch gear 31*a*.

As shown in FIG. 3, the coil springs 33 and 35 are bended at their ends respectively so as to resiliently support the push latch 32*a* and the holding latch 34 such that the push latch 32*a* and the holding latch 34 can keep the engagement with the teeth of the latch gear 31*a* of the latch drums 31 in normal condition.

When the latch handle 32 is pulled, the push latch 32*a* is moved in the counterclockwise direction in engagement with the latch gear 31*a,* and when the latch handle 32 is released, the push latch 32*a* is moved in the clockwise direction, sliding along the inclined plane of the latch gear 31*a* to release the engagement with the latch gear 31*a*.

The holding latch 34 is positioned in the opposite direction to the push latch 32*a* in engagement with the latch gear 31*a* so as to prevent the latch drums 31 from contrary rotation. By holding latch, though the latch handle 32 and the push latch 32*a* are rotated in the clockwise direction, the latch drums 31 are not rotated.

The cutting means according to the present invention is operated by only one forward sliding of the sliding member 41. That is, if the user pushes forward the sliding member 41 with his thumb, the movable bar 42 engaged with the protrusion 41*a* of the sliding member 41 is simultaneously moved forward such that the lever 43 is pressed down by a pressure of the projection part 42*a* of the bar 42, and then, the holder 45 and the cutter 47 simultaneously comes down to cut the adhesive tape 21.

The lever 43 has an end part mounted pivotally on the hinge 49*b* and the other end part has a pin 43*a* and is detachably connected with the cutter 47 by the pin 43*a*.

At the other end part connected with the cutter 47, the holder 45 is positioned to prevent the movement of the drawn adhesive tape 21 and to hold the adhesive tape 21 in a tight condition to be cut clean.

The supporting spring 44 mounted under the middle part of the lever 43 serves to give an elasticity to the lever 43 to be returned to its original position.

As described above, by the forward sliding of the sliding member 41, the movable bar 42 presses the lever 43 to lower the holder 45 and the cutter 47 connected to the lever 43 to the location of the adhesive tape 21, so that the holder 45 holds the drawn adhesive tape 21 with a lower surface of the outlet 11*b*. And then, the lever 43 with the cutter 47 is lowered further so that the cutter 47 cuts the adhesive tape 21.

If the user takes his thumb away from the sliding member 41, the lever 43 returns to its original position by the elasticity of the supporting spring 44, and the holder 45, the cutter 47, the movable bar 42 and the sliding member 41 also return to their original positions.

It will be appreciated that a spring guide can be positioned to guide the up and down movement of the cutter 47.

Through the process as described above, the user can use the adhesive tape 21 from the adhesive tape dispenser. If the adhesive tape 21 is all used up, the user separates the cover 12 from the case body 11, and replaces the adhesive tape of roll type. Therefore, the adhesive tape dispenser according to the present invention can be used semipermanently.

As described hereinabove, according to the present invention, the adhesive tape may be automatically drawn by the drawing means as long as the user desires and cut automatically by the cutting means so that the user may use the adhesive tape conveniently.

Although the present invention has been described with reference to preferred embodiments, it will be apparent to one skilled in the art that variations may be made thereto without departing from the scope of the invention as claimed hereinafter.

What is claimed is:

1. An automatic drawing and cutting device for an adhesive tape dispenser, the adhesive tape dispenser comprising:

a case body for containing an adhesive tape therein, the case body having a cover which is detachably mounted, an outlet through which an adhesive tape is passed;

drawing means for drawing the adhesive tape from the adhesive tape dispenser into a desired length; and cutting means for cutting the adhesive tape drawn by the drawing means, characterized in that, the drawing means includes a pair of latch drums having a latch gear on their inner peripherals respectively and a shaft integrally formed at a middle part thereof;

a latch handle pivotally mounted on the shaft of the latch drums and having a pin formed integrally;

a push latch pivotally mounted on the latch handle by the pin of the latch handle, the push latch being engaged with one of the teeth of the latch gear;

a first and a second brackets positioned between the latch drums, each end part of the brackets being mounted in the case body by pin joint;

a holding latch pivotally mounted by a pin of the second bracket in opposite direction of the push latch and engaged with one of the teeth of the latch gear to prevent a contrary rotation of the latch drums;

a first coil spring located on the shaft of the latch drums, the first coil spring resiliently supporting the latch handle and the push latch;

a second coil spring positioned on a pin of the second bracket and resiliently supporting the holding latch; and a pair of rollers connected with the latch drums by a pair of belts, each of the belts surrounding circumferences of the latch drums and the rollers, and the cutting means includes a sliding member slidingly positioned on an upper part of the case body and having a protrusion;

a movable bar movable by forward sliding of the sliding member and having a projection part, the movable bar pivotally mounted by a first hinge of the case body, a top end part of the movable bar being engaged with the protrusion of the sliding member;

a lever pivotally mounted by a second hinge of the case body and pressed down by pressure of the projection part of the movable bar moving forward;

a cutter detachably mounted at a front end of the lever; and a holder for supporting the cutter and holding the adhesive tape during cutting operation, the holder positioned at the front end of the lever having the cutter and connected to the lever by a pin-shaped spring, wherein when the sliding member is pulled forward, the lever is pressed down by the pressure of the movable bar moving forward and the cutter connected with the lever is lowered to cut the adhesive tape.

2. An automatic drawing and cutting device for an adhesive tape dispenser according to claim 1, wherein the first coil spring has one end part pressing one side of the push latch and the other end part hooking up a pin of the second bracket in order for the first coil spring to resiliently support the latch handle and the push latch, so that the latch handle and the push latch can be returned to their original positions after the latch handle is pulled into counterclockwise direction.

3. An automatic drawing and cutting device for an adhesive tape dispenser according to claim 1, wherein the cutting means further includes a supporting spring located under the lever, the supporting spring for resiliently supporting the lever to return the pressed down lever to its original position.

4. An automatic drawing and cutting device for an adhesive tape dispenser according to claim 1, wherein the case body includes a protruded semicircular part integrally formed at an upper front end part thereof, the protruded semicircular part pressing down the drawn adhesive tape so that the adhesive tape can be attached to an object.

* * * * *